United States Patent [19]

Mitsumori

[11] Patent Number: 4,758,828

[45] Date of Patent: Jul. 19, 1988

[54] COLOR THIN-FILM EL DISPLAY DEVICE

[75] Inventor: Kenichi Mitsumori, Furukawa, Japan

[73] Assignee: Alps Electric Co., Ltd., Japan

[21] Appl. No.: 931,669

[22] Filed: Nov. 17, 1986

[30] Foreign Application Priority Data

Nov. 21, 1985 [JP] Japan ..... 60-262214

[51] Int. Cl.[4] ..... G09G 3/30

[52] U.S. Cl. ..... 340/703; 340/701; 340/781

[58] Field of Search ..... 340/781, 701, 703

[56] References Cited

U.S. PATENT DOCUMENTS 4,005,402 1/1977 Amano ..... 340/781
4,155,030 5/1979 Chang ..... 340/781
4,540,983 9/1985 Morimoto et al. ..... 340/703
4,559,535 12/1985 Watkins et al. ..... 340/781
4,646,079 2/1987 Kitai et al. ..... 340/781

FOREIGN PATENT DOCUMENTS 0150991 8/1985 European Pat. Off. ..... 340/781

*Primary Examiner*—Howard A. Birmiel
*Attorney, Agent, or Firm*—Guy W. Shoup

[57] ABSTRACT

A color thin-film EL display device is disclosed which comprises an EL light emitting layer including a plurality of regions emitting light of different colors and groups of electrodes for selectively applying voltage to each of the regions in the EL light emitting layer. The EL light emitting layer has three kinds of regions exhibiting the three primary colors and the regions of each kind are disposed in a distributed manner.

3 Claims, 3 Drawing Sheets

COLOR THIN-FILM EL DISPLAY DEVICE

BACKGROUND OF THE INVENTION

1. Field of the Invention

The present invention relates to a color thin-film EL display device having a plurality of display regions emitting light of different colors and adapted such that the display regions are selectively caused to emit light and a multicolored display is thereby made possible.

2. Description of the Prior Art

Recently, thin-film EL display devices are applied to displays for various apparatuses. General prior art color thin-film EL display devices are formed, as shown in FIG. 6, in a double insulation type six-layer structure, a structure in which a transparent conductive film 2, insulating film 3, EL light emitting layer 4, insulating film 5, and a counter electrode film 6 are piled up on a transparent glass substrate 1 one after another. The thin-film EL display device emits light by being applied with a.c. electric field of several tens Hz to several KHz between the transparent conductive film 2 and the counter electrode film 6 whereby active seed ions within the EL light emitting layer 4 are excited. In such a case, the EL light emitting layer 4 is constituted of a base material formed of ZnS, ZnSe, and the like and activators such as Cu, Cl, Mn, $TbF_3$, $SmF_3$, $TmF_3$ added thereto, and the emitted colors can be changed by the kinds of the activators.

The conventional thin-film EL display devices have so far been more extensively used as surface light sources, and there have been made not so many studies on the thin-film EL display device which is capable of colored displaying by itself. As a device to make a colored display, the one as indicated in FIG. 7 is known, which is formed of thin-film EL display devices A, B, C, emitting light of different colors, piled up one after another, and respective patterns in the devices A, B, and C are adapted to be selectively caused to emit light to make the multicolored display.

In the above mentioned color display, however, since three devices A, B, and C must be used, their relative positions and so on made the structure complex. Also, since the light from the device disposed on the rearward side was visually sensed through the device disposed on the display surface side, there was such a demerit that the emitted colors are disturbed.

SUMMARY OF THE INVENTION

A primary object of the present invention is the provision of a color thin-film EL display device capable of a multicolored display.

The color thin-film EL display device according to the invention comprises an EL light emitting layer including a plurality of regions emitting light of different colors and groups of electrodes for selectively applying voltage to the regions in the EL light emitting layer.

Therefore, a multicolored display of any pattern can be made by selectively applying voltage to the regions in the EL light emitting layer to cause them to emit light in such a way that the light of different colors emitted by the different regions are properly combined.

According to a preferred embodiment of the invention, the EL light emitting layer has three kinds of regions for displaying the three primary colors, and these kinds of regions are disposed in a distributed manner. In this embodiment, the three kinds of regions are adapted to be selectively caused to emit light in such a way that the light of the three primary colors are properly combined to enable any color to be displayed.

According to the preferred embodiment of the invention, the mentioned groups of electrodes are constituted of a group of X electrodes formed on a transparent insulating substrate and a group of Y electrodes disposed on the rearward side thereof with the EL light emitting layer disposed therebetween, wherein the regions in the EL light emitting layer are located at the intersections of the group of X electrodes and the group of Y electrodes. In this embodiment, it is enabled to apply voltage to any of the regions in the EL light emitting layer to cause the same to emit light by selection of the electrode of the group of X electrodes and the electrode of the group of Y electrodes to apply voltage thereto.

According to another preferred embodiment of the invention, a transparent conductive film divided into divisions is formed on a transparent insulating substrate such that each division corresponds to each region in the EL light emitting layer and individual electrodes and a common electrode are disposed on the rearward side with the EL light emitting layer interposed therebetween, in which the individual electrode is disposed to correspond to each region in the EL light emitting layer and the common electrode is disposed to partially overlay all of the regions in the EL light emitting layer and keep a predetermined space apart from the individual electrodes. And the lead-in lines to terminals of the individual electrodes are wired in a three-dimensional manner on the rear side with an insulating film interposed therebetween.

In the above mentioned embodiment, the transparent conductive film formed on the transparent insulating substrate serves to form an equipotential surface, to which voltage is not directly appleid. The voltage is applied between the individual electrode and the common electrode disposed on the rearward side with the EL light emitting layer interposed therebetween. When a voltage is applied between the individual electrode and the common electrode, since both the electrodes are kept at a predetermined space apart from each other, an electric field is developed between both the electrodes on the rear side and the transparent conductive film on the substrate, whereby a specific region in the EL light emitting layer located in the petinent position is caused to emit light. In the present embodiment, since the lead-in lines to the terminals of the individual electrodes are wired in a three-dimensional manner with the insulating film formed on the rear side interposed therebetween, application of voltage at the portion of the lead-in lines connected to the terminals is prevented and it is thus made possible to increase the density of the wiring pattern. Also, since the voltage is applied between the individual electrode and the common electrode on the rearward side and not applied to the transparent conductive film on the substrate, it is made easy to form the pattern of the transparent conductive films.

Incidentally, the EL light emitting layer including a plurality of regions emitting light of different colors are provided by preparing a plurality of kinds of EL materials, constituted of a base material formed of ZnS, ZnSe, and the like and different activating materials selected from Cu, Cl, Mn, $TbF_3$, $SmF_3$, $TmF_3$, and the like added thereto, and then by sputtering or evaporating these EL materials in succession through masks. Such a method is also applicable that the above mentioned base material is first sputtered or evaporated and then the above mentioned activating materials are injected into respective regions by an ion injecting method.

DESCRIPTION OF THE PREFERRED EMBODIMENT

Figure 1:
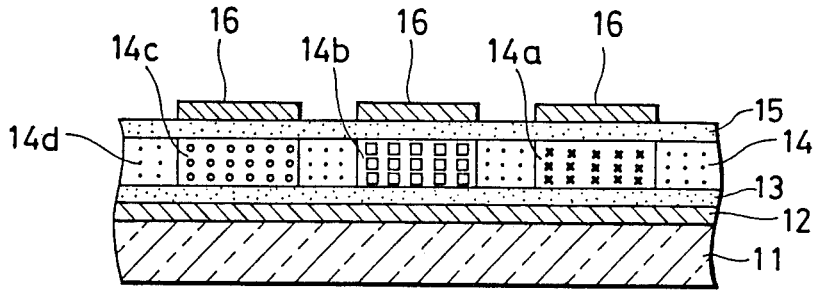
FIG. 1 is a partially cross-sectional view showing an embodiment of a color thin-film EL display device of the present invention.
Figure 2:
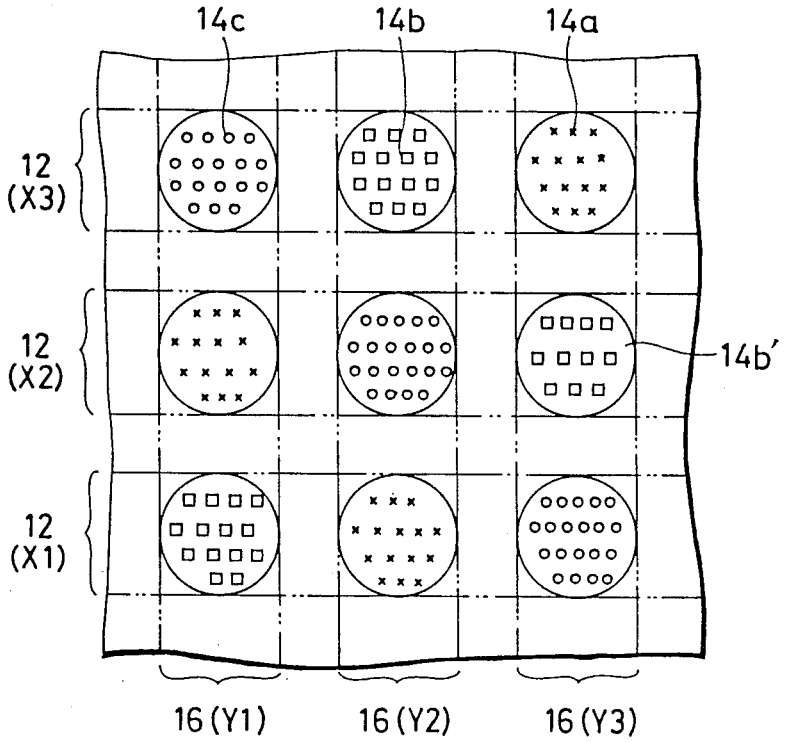
FIG. 2 is a structural plan view showing the color thin-film EL display device.

FIGS. 1 and 2 show one preferred embodiment of a color thin-film EL display device according to the present invention.

In the color thin-film EL display device, there is provided a transparent electrode 12 formed of an ITO film or the like on an insulating substrate 11 made of quartz or the like. The transparent electrode 12 is divided into a plurality of electrodes disposed in parallel and constituting a group of X electrodes (X1, X2, X3, . . . ). On the transparent electrode 12, there is formed an insulating film 13 made from $Ta_2O_5$ or the like, and over the same is formed an EL light emitting layer 14. The EL light emitting layer 14 includes red light emitting regions 14*a*, green light emitting regions 14*b*, blue light emitting regions 14*c*, and nonilluminating regions 14*d*. The red light emitting region 14*a* is constituted of ZnS and Sm, F added thereto (Sm 1% by weight), the green light emitting region 14*b* is constituted of ZnS and Tb, F added thereto (Tb 4% by weight), the blue light emitting region 14*c* is constituted of ZnS and Tm, F added thereto (Tm 1% by weight), and the nonilluminating region 14*d* is constituted of ZnS only. These light emitting regions 14*a*, 14*b*, 14*c* are respectively arranged in a distributed manner. The EL light emitting layer 14 is provided in a film formed on the transparent insulating substrate 11 by sputtering, in succession, the previously mentioned EL materials on the transparent insulating substrate 11 kept at the temperaturae of about 250° C., at predetermined portions with masks applied. After the film has been formed, it is preferable that the film is annealed at the temperature of about 600° C. and in the vacuum lower than $5\times10^{-3}$ Pa for about one hour. Over the EL light emitting layer 14 is formed an insulating film 15, and over the same are formed a counter electrode 16. The counter electrodes 16 are divided into a plurality of electrodes disposed in parallel and constituting a group of Y electrodes (Y1, Y2, Y3, . . . ). The group of X electrodes and the group of Y electrodes cross at right angles and at the intersections are disposed the light emitting regions 14*a*, 14*b*, 14*c*.

With the described arrangement, if a voltage is applied between the electrode X2 of the group of X electrodes and the electrode Y3 of the group of Y electrodes, the green light emitting region 14*b*′ in the EL light emitting layer 14 located at the intersection emits green light. In like manner, if a voltage is applied between an electrode of the group of X electrodes and an electrode of the group of Y electrodes, the specific region in the EL light emitting layer located at the intersection emits any of red, green, or blue light. Thus, by selectively applying a voltage between a specific electrode of the group of X electrodes and a specific electrode of the group of Y electrodes, a desired region in the EL light emitting layer 14 can be made to emit light, and by combining the light emissions from various regions in the EL light emitting layer 14, it is enabled to make a multicolored display of any desired pattern.

Figure 3:
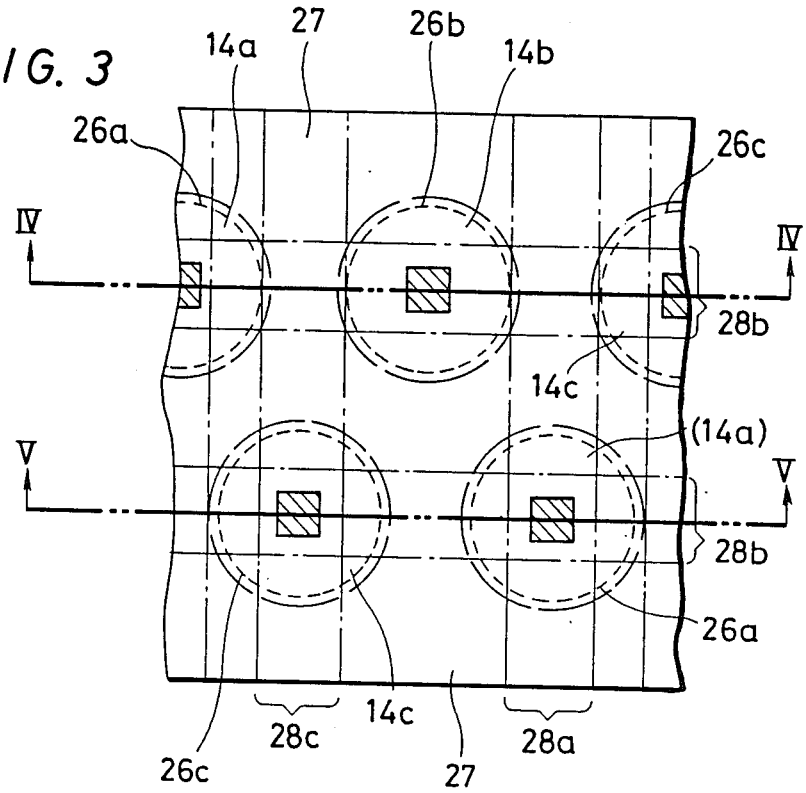
FIG. 3 is a structural plan view showing another embodiment of the color thin-film EL display device of the invention.
Figure 4:
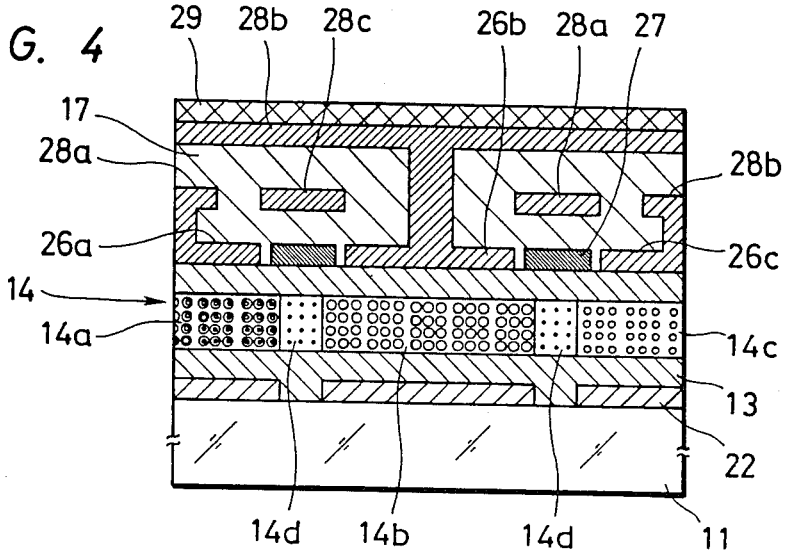
FIG. 4 is a cross-sectional view taken along line IV—IV of FIG. 3.
Figure 5:
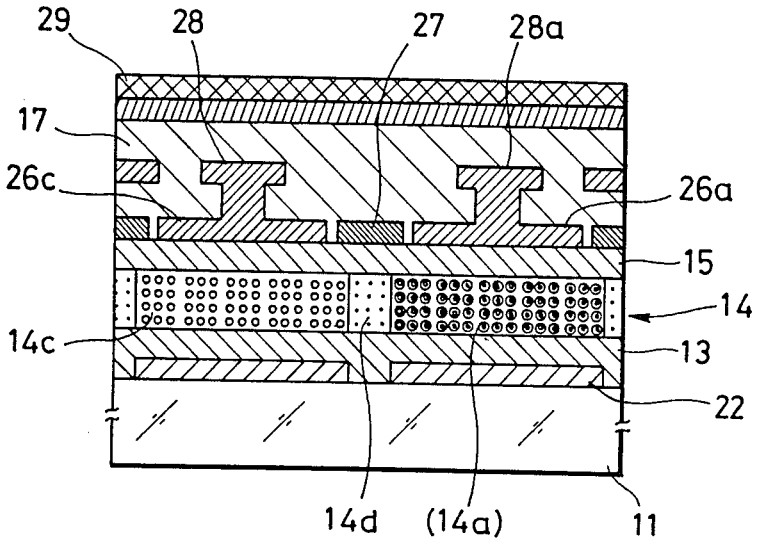
FIG. 5 is a cross-sectional view taken along line V—V of FIG. 3.
Figure 6:
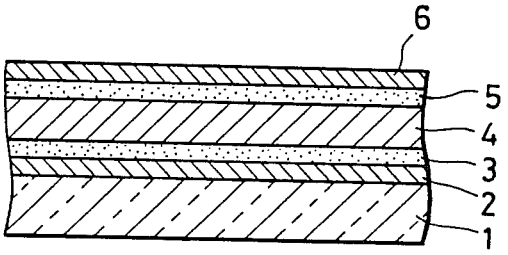
FIG. 6 PRIOR ART
FIG. 6 is a partially cross-sectional view showing an example of prior art thin-film EL display devices.
Figure 7:
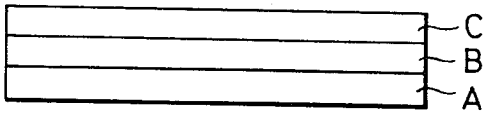
FIG. 7 PRIOR ART
FIG. 7 is a side view showing an example of prior art color thin-film EL display devices.

FIGS. 3, 4, and 5 indicate another preferred embodiment of the color thin-film EL display device according to the present invention.

In the present color thin-film EL display device, there is formed a transparent conductive film 22 made of an ITO film or the like divided into a plurality of divisions on a transparent insulating substrate 11 made of glass or the like. Over the transparent conductive film 22, there is formed an insulating film 13 made from $Ta_2O_5$ or the like, and over the same is formed an EL light emitting layer 14. The EL light emitting layer 14 includes red light emitting regions 14*a*, green light emitting regions 14*b*, blue light emitting regions 14*c*, and the nonilluminating regions 14*d* the same as in the previous embodiment. The light emitting regions 14*a*, 14*b*, 14*c* are disposed to oppose the divisions of the above mentioned transparent conductive film 22. By the way, the EL light emitting layer 14 can be provided by sputtering, the same as in the previously described embodiment. Over the EL light emitting layer 14, there are formed individual electrodes 26*a*, 26*b*, 26*c* and a common electrode 27 with an insulating film 15 similar to the above mentioned one interposed therebetween. The individual electrode 26*a* is disposed to oppose the red light emitting region 14*a* in the EL light emitting layer 14, the individual electrode 26*b* is disposed to oppose the green light emitting region 14*b* in the EL light emitting layer 14, and the individual electrode 26*c* is disposed to oppose the blue light emitting region 14*c* in the EL light emitting layer 14. And, the common electrode 27 is disposed so as to partially overlap with all of the regions 14*a*, 14*b*, 14*c* in the EL light emitting layer 14 and kept a predetermined space apart from the individual electrodes 26*a*, 26*b*, 26*c*. Although it is not shown in the drawings, the common electrode 27 is also divided into a group of plural electrodes, which together with the individual electrodes 26*a*, 26*b*, 26*c* constitute a matrix of electrodes. On the further rearward side of these individual electrodes 26*a*, 26*b*, 26*c* and common electrode 27, there is formed an insulating film 17, and lead-in lines 28*a*, 28*b*, 28*c* connected to the terminals of the individual electrodes 26*a*, 26*b*, 26*c* are wired in a three-dimensional manner on this side with the insulating film 17 interposed therebetween. By the way, reference numeral 29 in the drawing denotes a passivation film.

With the above described arrangement, suppose now that a voltage is applied between a lead-in line 28*a* to the terminal of the individual electrode 26*a* and the common electrode 27 (refer to FIGS. 3 and 5). Both the electrodes 26*a* and 27 are disposed close to each other in the portion where the red light emitting region 14*a* in the EL light emitting layer 14 is located, and the mentioned voltage acts on the transparent conductive film 22 on the transparent insulating substrate 11 located at the corresponding portion, so that an electric field is developed between both the electrodes 26a, 27 and the transparent conductive film 22, whereby the red light emitting region 14a in the EL light emitting layer 14 is made to emit red light. In like manner, if a voltage is applied between the lead-in line 28b for the individual electrode 26b and the common electrode 27, the green light emitting region 14b in the EL light emitting layer 14 is caused to emit green light. Further, if a voltage is applied between the lead-in line 28c for the individual electrode 26c and the common electrode 27, the blue light emitting region 14c in the EL light emitting layer 14 is made to emit blue light. In the described manner, by selectively applying voltage to the individual electrodes 26a, 26b, 26c, light of any desired color can be made to be emitted, and thus, by combining emitted light of various colors, it becomes possible to provide a multicolored display.

As described so far, the device according to the present invention is provided with an EL light emitting layer including a plurality of regions emitting light of different colors and these regions in the EL light emitting layer are adapted to be selectively applied with voltage, and so, it has been made possible to cause each of these ranges to emit light of its specific color and thereby to provide a multicolored display.

What is claimed is:

1. A color thin-film EL display device comprising in depthwise order:

a transparent insulating substrate in a plane;

a plurality of X electrodes formed in parallel in a plane on said transparent insulating substrate;

a first insulating film formed in a plane on said X electrodes;

an EL layer formed in a plane having a plurality of EL divisions each comprising a material providing a different color of emitted light and each positioned in depthwise alignment with a respective one of said plurality of X electrodes;

a second insulating film formed in a plane on said EL layer; and a plurality of Y electrodes extending in parallel in a plane along a direction orthogonal to said X electrodes, wherein said EL divisions are each positioned in depthwise alignment with a respective one of said plurality of Y electrodes, whereby individual ones of said different color EL divisions are selectively activated to emit different color light by said respective ones of said X and Y electrodes to form a multi-color display.

2. A color thin-film EL display device according to claim 1, wherein said EL layer has different divisions emitting light of three different colors, and each display unit of the display device is made up of the intersection of a grouping of three rows of X electrodes and a grouping of three columns of Y electrodes forming nine activatable light emitting areas, and nine EL divisions comprising three divisions for each of the three colors are distributed among the activatable emission areas so that a different color EL division is in each of the X rows and each of the Y columns.

3. A color thin-film EL display device comprising in depthwise order:

a transparent insulating substrate in a plane;

a transparent conductive film formed as a plurality of spaced apart divisions distributed in orthogonal X and Y directions in a plane on said transparent insulating substrate;

a first insulating film formed in a plane on said transparent conductive film;

an EL layer formed in a plane having a plurality of spaced apart EL divisions each comprising a material providing a different color of emitted light and each positioned in depthwise alignment with a respective one of said plurality of transparent conductive divisions;

a second insulating film formed in a plane on said EL layer; and a plurality of spaced apart individual electrodes formed in a plane wherein each of said electrodes is positioned in depthwise alignment with a respective one of said plurality of transparent conductive divisions, and a plurality of common electrodes spaced from but in proximity to the individual electrodes and positioned so as to partially overlap in depthwise alignment with the transparent conductive divisions, such that upon application of a voltage between a selected individual electrode and a common electrode, an electric field is developed across to the respective transparent conductive division in depthwise alignment therewith to cause the corresponding EL division therebetween to emit a selected color light;

a third insulating film formed on said individual and common electrodes; and a plurality of lead in wires extending through the third insulating film in a three dimensional manner to respective ones of said electrodes, whereby individual ones of said different color EL divisions are selectively activated to emit different color light by said respective individual electrodes to form a multi-color display.

* * * * *